US005542725A

United States Patent [19]

Ballew

[11] Patent Number: 5,542,725

[45] Date of Patent: Aug. 6, 1996

[54] PORTABLE DOOR STOP

[75] Inventor: Chester N. Ballew, New Albany, Ind.

[73] Assignee: E2 Enterprises, Inc., Jeffersonville, Ind.

[21] Appl. No.: 366,896

[22] Filed: Dec. 30, 1994

[51] Int. Cl.[6] ..... E05C 17/54

[52] U.S. Cl. ..... 292/339; 292/288

[58] Field of Search ..... 292/288, 339, 292/338, DIG. 15

[56] References Cited

U.S. PATENT DOCUMENTS

| | | | |
|---|---|---|---|
| 1,830,296 | 11/1931 | Siino | 292/338 |
| 2,595,709 | 5/1952 | Sands | 292/339 |
| 2,709,615 | 5/1955 | Barnes, Jr. et al. | 292/339 |
| 2,774,622 | 12/1956 | Priebe | 292/288 |
| 2,807,490 | 9/1957 | Stachura | 292/288 |

FOREIGN PATENT DOCUMENTS

| | | | |
|---|---|---|---|
| 569113 | 1/1959 | Canada | 292/339 |

*Primary Examiner*—Rodney M. Lindsey
*Attorney, Agent, or Firm*—Gary M. Gron

[57] ABSTRACT

A portable door stop comprising a pair of door engaging elements connected to one another by parallel links. A spring extends between the elements to draw them together against opposite faces of a door. A floor or ground engaging element is pivotally mounted to one of the elements so that when it is in place, movement of the door causes the elements to more tightly engage the door. The portable door stop may be used for doors which close in either direction.

13 Claims, 1 Drawing Sheet

PORTABLE DOOR STOP

TECHNICAL FIELD

The present invention relates to door stops and more particularly to portable door stops.

BACKGROUND ART

Door stops,in one form or another, have been around since the invention of various means to bias hinged doors towards a closed position. Most commercially available door stops involve some form of a permanently mounted leg or arm which can be pivoted or displaced so that it makes frictional contact with the ground, floor, or an entry way stoop. Examples are found in U.S. Pat. Nos. 1,985,164, 2,217,996, and 3,831,989 which all show floor engaging elements which are permanently pivotally mounted to one side of a door. The problem with this type of door stop is that it is difficult to disconnect from one door and apply to another. In addition, according to some fire codes, permanent door stops are prohibited from being installed on a building exit door. This presents a particular problem for persons who make deliveries in commercial buildings where a door needs to be held in an open position until bulky objects such as furniture, appliances, or the like, pass through the door.

A number of proposals have been made in the art to provide removable door stops using the same principle of pivoted floor engaging members. Examples of this type of arrangement may be found in U.S. Pat. Nos. 2,709,615, 2,739,005 and 2,774,622. Aside from U.S. Pat. No. 2,774,622 the arrangements do not have an ability to accommodate doors of varying thickness. The design in U.S. Pat. No. 2,774,622 utilizes a clamping mechanism which is a difficult and cumbersome device to accommodate adjustable doors owing to the time it takes to thread the clamping mechanism in place.

DISCLOSURE OF THE INVENTION

The above and other problems are solved by the present invention in which a door stop is provided that has first and second elements incorporating opposed surfaces for abutting the opposite faces of a door. A means is provided for variably linking the first and second elements to abut opposite faces of different door thicknesses. A means is provided for yieldably biasing the first and second elements towards a minimum door thickness position so that the door engaging elements may be used on doors of different thicknesses. Finally, a floor engaging leg is mounted on one of the elements to prevent movement of the door on which the stop is positioned.

BEST MODE FOR CARRYING OUT THE INVENTION

Figure 1:
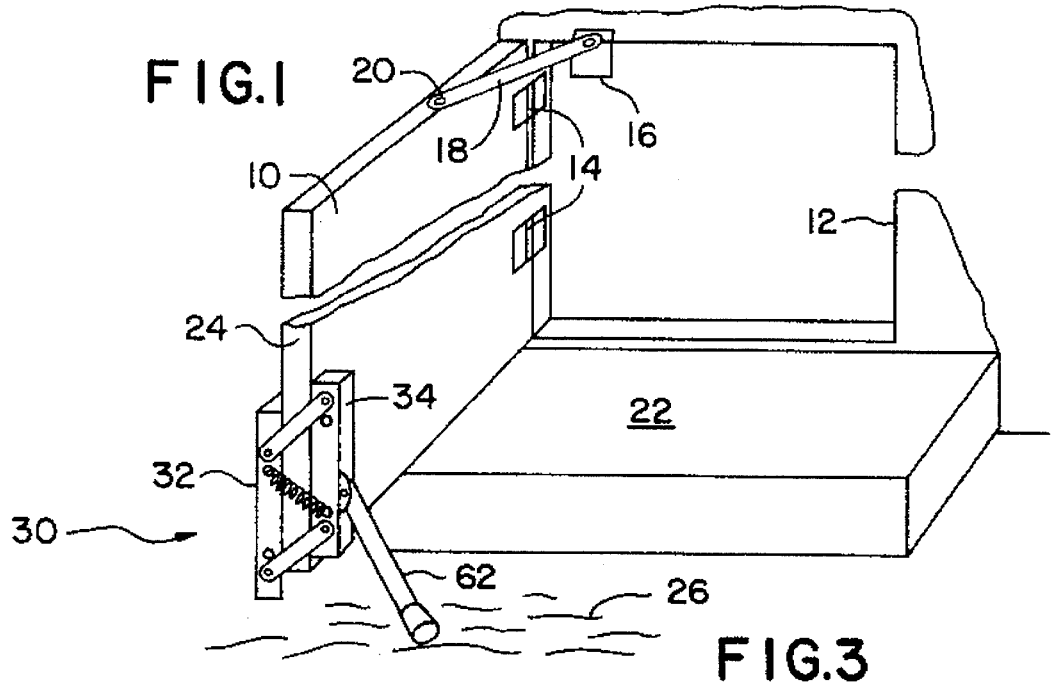
FIG. 1 is a perspective view of a portable door stop embodying the present invention in place on a door.

FIG. 1 shows a portable door stop of the present invention in place on a heavy duty commercial door 10 hinged to a doorway 12 by hinges 14. A commercial grade door closure component 16 has an arm 18 pivotally mounted to the door at 20 to bias the door to the closed position from the illustrated open position. In a typical arrangement the door 10 can open to the exterior side of a building and a stoop or step 22 is immediately adjacent the door opening 12. However, the outer edge 24 of the door 10 swings well beyond the stoop 22 so that it is some distance from the ground 26. A portable door stop 30 embodying the present invention, as will be described below, is able to accommodate the variable distance to the ground for commercial type doors, adequately resist the usual very strong closing forces by the door closure member 16, and can be quickly and easily installed on doors of variable thickness and opening both ways.

Figure 3:
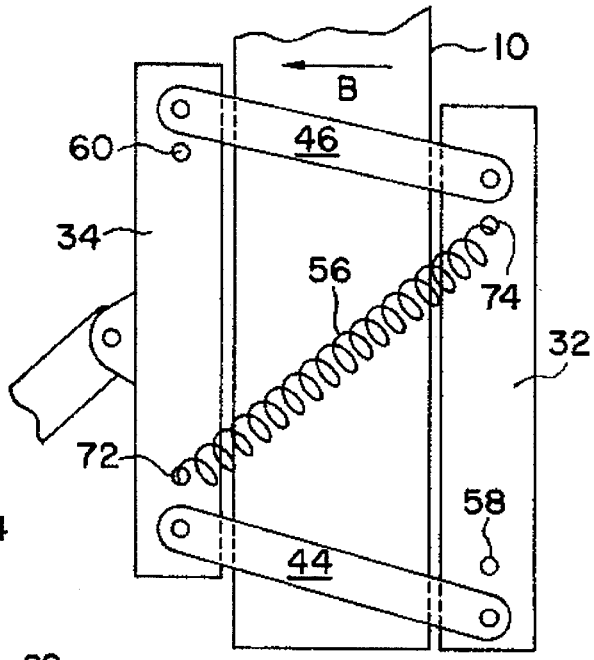
Figure 2:
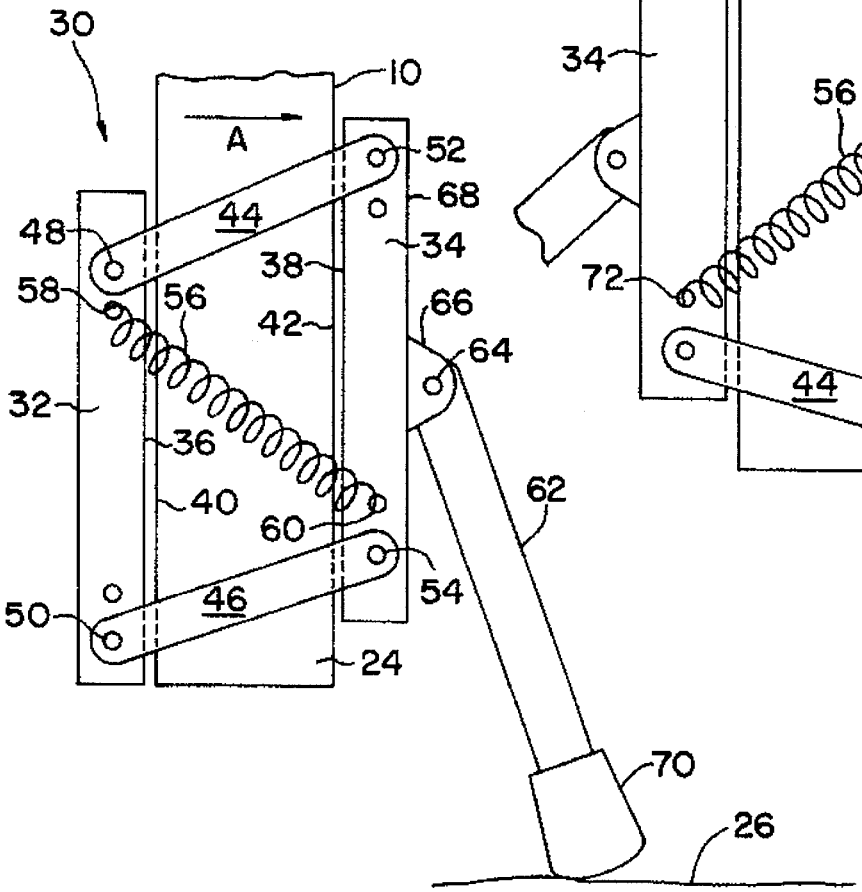
FIG. 2 is an end view of the door stop of FIG. 1 preventing door movement from left to right; and, FIG. 3 is an end view of the door stop of FIG. 1 showing it in position to prevent door movement from right to left.

Referring to FIGS. 2 and 3, the portable door stop 30 comprises first and second elements 32 and 34 respectively, each having opposed abutment surfaces 36 and 38 respectively, which contact opposite faces of the door 10. Elements 32 and 34 may be made from any one of a number of appropriate materials. For the illustrated preferred embodiment, the elements 32 and 34 are fashioned from square cross section aluminum extrusions. Each of the elements 32 and 34 have friction surfaces 40 and 42 on the abutment surfaces 36 and 38, respectively. The friction surfaces 40 and 42 may be formed from appropriate friction material, for example, rubber. As shown, the friction material covers the entire surface. It should be apparent, however, that a lesser portion of the abutment surfaces 36 and 38 may be covered with a friction material and still achieve the benefits of the invention.

The first and second elements 32 and 34 are variably linked by an appropriate mechanism. As illustrated, the linking mechanism comprises first and second parallel links 44 and 46 pivotally connected to element 32 by upper and lower pins 48 and 50, respectively. The links 44 and 46 are pivotally connected to element 34 by upper pin 52 and lower pin 54. As is the case with a commercial embodiment, the links 44,46 can be made from appropriate material, herein illustrated as aluminum plate for lightness. Further, the pins 48–54 forming the pivots may be formed from any one of a number of devices. It has been found that rivet assemblies give an economical and straight forward method of construction.

As illustrated, the parallel links 44 and 46 allow the elements 32 and 34 to move towards and away from one another while maintaining a parallel relationship between their abutment surfaces 36 and 38. The links 32 and 34 are biased towards a position wherein they accommodate a minimum door thickness by means of a spring 56 connected between the elements 32 and 34 by means of posts 58 and 60 respectively. It should be noted that in the position illustrated in FIG. 2 the spring 56 extends between the elements 32 and 34 so that it is at an acute angle relative to the direction of the parallel links 44 and 46 and preferably as close to a right angle as possible. This causes the links to pivot in such a way that the elements 32 and 34 are moved towards the minimum door thickness position.

On one of the elements, herein illustrated as element 34, a floor or ground engaging element 62 is pivotally mounted by means of a shaft 64 extending through a pair of webs 66 appropriately secured to the face 68 of element 34 that is opposite the abutment face of 38. The floor engaging element 62 has sufficient length so that when element 34 is at or near the bottom of the door 10, the element 62 will extend sufficiently to engage the ground 26 as in the illustration of FIG. 1 where a stoop 22 is arranged next to the door opening 12. In order to provide appropriate frictional engagement, a friction element 70 is positioned on the free end of floor or ground engaging element 62. As in the case with the other elements described in this invention, floor or ground engaging element 62 may be formed from any one of a number of materials. As illustrated, it is an aluminum tube and the friction element 70 is an appropriate diameter rubber cap used for tubular table legs.

Continuing to refer to FIG. 2, the adjustable door stop 30 is positioned on the door 10 by moving the elements 32 and 34 such that the links 44,46 swing in a clockwise direction so as to increase the space between the abutment surfaces 36 and 38. The elements 32 and 34 are then positioned on the end of the door 10 so that links 44 and 46 abut the outer edge 24 of the door 10. The elements 32 and 34 are released so that spring 56 can pull them together in such a way that the links 44 and 46 move in a counterclockwise direction and element 34 is at an elevational level higher than element 32. The floor or ground engaging element 62 is then swung downward in a clockwise direction so that it engages the surface 26 and is positioned approximately at a right angle to links 44,46. In this position, the portable door stop prevents movement of the door in the direction of arrow A or to the right as viewed in FIG. 2. It should be noted that the reaction force of moving the door 10 in direction A causes a force at the pivot 64 of floor engaging element 62 in a direction which causes the links 44 and 46 to move in a counterclockwise direction which further tightens elements 32 and 34 against the surface of the door. Therefore, as the rather substantial force of the commercial closing mechanism is applied to the portable door stop, it causes the door engaging elements 32 and 34 to engage the surface of the door even more tightly. It should also be noted that the elements 32 and 34 can be positioned up from the bottom of the door 10 so as to accommodate variable distances between the bottom of the door and the floor or ground 26. The arrangement of the portable door stop on the end of the door also provides an appropriate quick release. All that is necessary to release the door mechanism is to push it off the end of the door.

Up to now, the description covers a door which closes in the direction A. The portable door stop 32 has the ability to be used also on a door which closes in the direction B as shown in FIG. 3. In this figure the positions of elements 32 and 34 are reversed so that element 34 is on the left side of the door and element 32 is on the right side. It should also be noted that element 34 is again at an elevational level higher than element 32 but that movement of the parallel links 46 and 44 in a clockwise direction causes the elements 34 and 32 to move closer to one another. In this position, the floor or ground engaging element 62 is pivoted so that it extends in a direction approximately at a right angle to the parallel links 46 and 44. So that the spring 56 can be repositioned to be at an acute angle to parallel links 46 and 44 and preferably as close to a right angle as possible, it is connected to a second pair of posts 72 and 74 so that the spring 56 causes the links 46 and 44 to move in a clockwise direction. The benefits of self energizing and variable accommodations of ground or floor height are equal in this position. It also should be noted that the repositioning of the spring 56 is a relatively simple and straightforward matter allowing for rapid installation of the door stop in position on the end of the door.

While a preferred embodiment of the present invention has been described, it should be apparent to those skilled in the art that it may be practiced in forms other than specifically shown and still encompass the spirit and scope of the invention.

Having thus described the invention what is claimed is novel and desired to be secured by Letters Patent of the United States is:

1. A portable door stop comprising:

first and second elements having opposed surfaces for abutting the opposite faces of a door, means for variably linking said first and second elements to abut opposite faces of doors of different thicknesses and to maintain the abutting opposed surfaces of said first and second elements substantially parallel to one another, means for yieldably biasing said first and second elements toward a minimum door thickness position whereby the door engaging elements may be used on doors of different thickness, and a floor engaging leg mounted on one of said elements to prevent movement of said door.

2. A portable door stop as in claim 1 wherein said variable linking means comprises at least one link pivotally mounted to said first and second elements.

3. A portable door stop as in claim 2 wherein said variable linking means comprises a pair of parallel links spaced from one another and pivotally mounted to said first and second elements.

4. A portable door stop as in claim 2 wherein said yieldable biasing means comprises an elongated spring connected between said first and second elements in such fashion that it is not parallel thereto.

5. A portable door stop as in claim 1 wherein said floor engaging leg is pivotally mounted to one of said elements.

6. A portable door stop as in claim 1 wherein:

said first and second elements each have a generally square shaped cross section having a face thereon opposing one another to form said opposed surfaces which abut opposite surfaces of a door, said door stop further comprises friction surfaces on said abutment faces to frictionally abut the opposite faces of the door.

7. A portable door stop as in claim 6 wherein said friction surfaces are formed from rubber.

8. A portable door stop as in claim 6 wherein:

said first and second elements each have a mounting face at a right angle to said abutment face, the mounting faces of said first and second elements being substantially in the same plane, and said variable linking means comprises at least one link pivotally mounted to said first and second elements on said mounting faces whereby said portable door stop may be positioned on the outer edge of a door with the link and said opposed surfaces in contact with the door.

9. A portable door stop as in claim 8 having a second link parallel to said one link.

10. A portable door stop as in claim 9 wherein said yieldable biasing means comprises a spring connected between mounting points on the mounting faces of said first and second elements in such fashion that said spring is not parallel to said first and second elements.

11. A portable door stop as in claim 7 wherein said floor engaging leg comprises a tubular element pivotally mounted to one of said elements.

12. A portable door stop as in claim 11 wherein said tubular element is pivotally mounted to one of said elements at approximately the midpoint thereof so that it may be pivoted in such fashion that the doorstop may work in two directions.

13. A portable door stop as in claim 10 wherein said mounting faces each have a pair of spaced mounting points for said spring so that said spring may be selectively mounted to be generally parallel to said floor engaging leg regardless of the direction it is pivoted.

* * * * *